US010465319B2

(12) United States Patent
Nitschke et al.

(10) Patent No.: US 10,465,319 B2
(45) Date of Patent: Nov. 5, 2019

(54) METHOD AND APPARATUS FOR MAKING A SPUNBOND NONWOVEN FROM ENDLESS FILAMENTS

(71) Applicant: Reifenhaeuser GmbH & Co. KG Maschinenfabrik, Troisdorf (DE)

(72) Inventors: Michael Nitschke, Koenigswinter (DE); Martin Swiatek, Rheinbach (DE); Martin Neuenhofer, Cologne (DE); Hans-Georg Geus, Niederkassel (DE); Detlef Frey, Niederkassel (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 318 days.

(21) Appl. No.: 15/414,798

(22) Filed: Jan. 25, 2017

(65) Prior Publication Data

US 2017/0211217 A1 Jul. 27, 2017

(30) Foreign Application Priority Data

Jan. 27, 2016 (EP) ..... 16152916

(51) Int. Cl.

| | |
|---|---|
| ***D04H 3/02*** | (2006.01) |
| ***D01D 5/088*** | (2006.01) |
| ***D04H 3/16*** | (2006.01) |
| ***D01D 5/098*** | (2006.01) |

(52) U.S. Cl.

CPC ..... *D04H 3/02* (2013.01); *D01D 5/088* (2013.01); *D01D 5/0985* (2013.01); *D04H 3/16* (2013.01)

(58) Field of Classification Search

CPC ..... D01D 5/088; D01D 5/0985; D01D 5/098; D01D 5/092; D04H 3/16; D04H 3/02

See application file for complete search history.

(56) References Cited

U.S. PATENT DOCUMENTS

| | | | | |
|---|---|---|---|---|
| 5,545,371 | A * | 8/1996 | Lu | D01D 5/12 264/103 |
| 6,916,752 | B2 | 7/2005 | Berrigan | |
| 6,948,750 | B2 | 9/2005 | Federspiel et al. | |
| 2003/0178741 | A1* | 9/2003 | Hisada | D01D 5/088 264/211.22 |
| 2003/0178742 | A1* | 9/2003 | Geus | D01D 5/088 264/211.22 |

(Continued)

FOREIGN PATENT DOCUMENTS

DE 102013012345 A 1/2015

*Primary Examiner* — Alison L Hindenlang
*Assistant Examiner* — Debjani Roy
(74) *Attorney, Agent, or Firm* — Andrew Wilford

(57) ABSTRACT

An apparatus for making a spunbond nonwoven from endless filaments of a thermoplastic synthetic resin has a spinneret for spinning the filaments in a filament-travel direction into a spinning zone and a monomer aspirator downstream of the spinneret and having two vacuum intake ports flanking the spinning zone zone, horizontally confronting each other, and each extending transversely to the direction opposite one another. Suction means connected to the two ports withdraws gas through both the vacuum intake ports. The suction and/or the ports are set up to vary the flow through the vacuum intake ports such that substantially more gas flows through one of the ports than through the other.

20 Claims, 4 Drawing Sheets

(56) References Cited

U.S. PATENT DOCUMENTS

| | | | | |
|---|---|---|---|---|
| 2003/0216096 | A1* | 11/2003 | Berrigan | D01D 5/0985 442/334 |
| 2006/0145385 | A1 | 7/2006 | Fujii | |
| 2010/0062672 | A1* | 3/2010 | Fare' | D01D 5/0985 442/409 |
| 2010/0099321 | A1* | 4/2010 | Fare' | D01D 5/0985 442/401 |

* cited by examiner

METHOD AND APPARATUS FOR MAKING A SPUNBOND NONWOVEN FROM ENDLESS FILAMENTS

FIELD OF THE INVENTION

The present invention relates to a method of making a spunbond nonwoven. More particularly this invention concerns such a method that uses endless filaments of a thermoplastic polymer.

BACKGROUND OF THE INVENTION

In a method of making a spunbond nonwoven from endless filaments made of a thermoplastic polymer, a spinneret spins the filaments and a cooler is provided for cooling the spun filaments. Between the spinneret and the cooler at least one monomer aspirator aspirates gases released during the spinning process.

Endless filaments with their quasi-continuous length differ from staple fibers that have shorter lengths of 10 to 60 mm, for example. With the monomer aspirator, air and/or gas is vacuumed out of the filament-forming space directly beneath the spinneret. This achieves the result that gases emerging in the form of monomers, oligomers, decomposition products and the like along with the polymer filaments can be removed at least partially from the filament-forming space and/or from the apparatus.

Basically, such an apparatus in various embodiments is known from practice. With these apparatuses, the filaments are spun by a spinneret, then cooled in a cooler and next passed through a stretcher and ultimately deposited on a support to form a spunbond nonwoven. Such an apparatus is also referred to as a spunbonding machine. Many of these known apparatuses have the disadvantage that the filaments often cannot be deposited to form a spunbond nonwoven in a satisfactory manner without defects. Irregularities in the form of flaws or defects in the spunbond nonwoven occur while the filament is being deposited. The homogeneity of a spunbond nonwoven is impaired to a more or less great extent due to these defects and/or disturbances. So-called drips that result from one or more filaments pulling away and forming accumulations of melt are one cause of defects in a spunbond nonwoven. These drips create flaws, i.e. thick spots, in the spunbond nonwoven and/or stick to the support for the spunbond nonwoven. Such drips and/or defects are usually larger than 2×2 mm. Defects in the spunbond nonwoven also result from so-called "hard pieces" that occur in that due to loss of tension, a spun filament can relax, recoil and in this way form a cluster that sticks together because of the molten condition of the filament. In doing so, there is usually no breakaway of the filament. The resulting defects in the spunbond nonwoven are usually less than 2×2 mm in size and but they are usually tangible and/or visible. The present invention is based on the discovery that such defects and/or flaws occur in a spunbond nonwoven in particular at higher filament speeds and/or at throughputs greater than 120 kg/h/m and in particular greater than 150 kg/h/m. Such irregularities in the spunbond nonwoven can also be observed at greater spinning zone depths in particular.

There have been efforts in the past to reduce the problems described above by treating the filaments more uniformly in the cooler and/or cooling them more uniformly with cooling air, for example, in order to achieve a more uniform filament flow and/or a more uniform filament treatment. These measures have led to only limited success, in particular at higher throughputs. Therefore, the apparatuses known in practice need to be improved.

OBJECTS OF THE INVENTION

It is therefore an object of the present invention to provide an improved method and apparatus for making a spunbond nonwoven from endless filaments.

Another object is the provision of such an improved method and apparatus for making a spunbond nonwoven from endless filaments that overcomes the above-given disadvantages, in particular that produces a spunbond nonwoven with a high homogeneity and without any significant defects can be made, even at high filament speeds and/or high throughputs, as well as with wide and/or deep spinning zones.

SUMMARY OF THE INVENTION

An apparatus for making a spunbond nonwoven from endless filaments of a thermoplastic synthetic resin has according to the invention a spinneret for spinning the filaments in a filament-travel direction into a spinning zone and a monomer aspirator downstream of the spinneret and having two vacuum intake ports flanking the spinning zone zone, horizontally confronting each other, and each extending transversely to the direction opposite one another. Suction means connected to the two ports withdraws gas through both the vacuum intake ports. The suction and/or the ports are set up to vary the flow through the vacuum intake ports such that substantially more gas flows through one of the ports than through the other vacuum intake port. The filaments pass through a cooler downstream of the aspirator.

It is within the scope of the invention that the apparatus according to the invention is a spunbonding apparatus for making a spunbond nonwoven, the apparatus having a spinneret, a monomer aspirator, a cooler, a stretcher connected thereto for stretching the filaments as well as a deposition support for deposition of the filaments to form the spunbond nonwoven web.

Within the scope of the invention, machine direction (MD) refers in particular to the normally horizontal direction of conveyance of the spunbond nonwoven web after being deposited on the deposition support. As a rule, the spunbond nonwoven web is conveyed by a conveyor belt and/or a continuous conveyor belt. Within the scope of the invention, CD direction refers in particular to the normally vertical direction transverse to the direction of conveyance of the spunbond nonwoven web and/or to the MD direction.

The CD vacuum intake ports and/or the CD vacuum intake subports are advantageously provided in two opposite normally vertical side walls extending transversely to the machine direction, these side walls bordering the film-forming space beneath the spinneret. A CD vacuum intake port and/or a CD vacuum intake subport may be formed either by only a vacuum opening and/or a vacuum gap and/or a plurality of vacuum openings and/or vacuum gaps. Thus, for example, a CD vacuum intake port and/or a CD vacuum subport may also be formed by a plurality of vacuum holes. Within the scope of the invention, the fact that a higher volume flow can be removed by suction through one of the two CD vacuum intake ports and/or CD vacuum intake subports also means that no gas and/or essentially no gas can be removed by suction and/or is removed by suction through the other of the two CD vacuum intake ports and/or CD vacuum intake subports and a volume flow of gas is or can be removed by suction only through the one of the two CD vacuum intake ports and/or CD vacuum intake subports. The wording given above from patent claim 1 also includes the case when a volume flow of gas is supplied through one of the two CD vacuum intake ports and/or through the CD vacuum intake subports and a volume flow of gas is removed by suction through the other one of the two CD vacuum intake ports and/or CD vacuum intake subports. In this case a higher volume flow of gas is also removed by suction through the latter CD vacuum intake port and/or CD vacuum intake subport than through the other subport.

It is within the scope of the invention that the volume flow(s) removed by suction in the monomer aspirator enter(s) at least one collecting chamber and preferably at least one collecting duct connected to the collecting chamber. At least one collecting chamber and preferably at least one collecting duct connected to each collecting chamber is advantageously provided for receiving the gas removed by suction for each of two CD vacuum intake ports on the opposite side of the spinning zone. For each one of these sides, there may also be a plurality of collecting chambers and/or collecting ducts. At least one suction line, preferably a plurality of suction lines, is connected to each collecting chamber for suction removal of the gas and according to recommendation the at least one suction line(s) connect(s) the collecting chamber to a collecting duct. The volume flow can be adjusted by at least one cutoff element—for example, by a cutoff slide valve with a linear guide for adjusting the open cross section—following at least one collecting chamber and advantageously in at least one connected suction line. The adjustment and/or throttling take(s) place within the scope of the invention such that a higher volume flow can be removed by suction through the one of the CD vacuum intake ports on the opposite side of the spinning zone than through the other CD vacuum intake port.

Within the scope of the invention, the vacuum removal of a higher volume flow on one side of the monomer suction and/or through a CD vacuum intake port and/or CD vacuum intake subport can basically be implemented

- in that the opening widths and/or flow cross sections of the CD vacuum intake ports and/or CD vacuum intake subports are designed accordingly and/or are adjustable accordingly, and/or
- in that the suction removal of the volume flow—in particular in or at the at least one collecting chamber and/or in or at the suction line(s) can be adjusted and/or throttled for suction removal of the gas and/or in or at the at least one collecting duct.

It is within the scope of the invention that there may also be a change between the two sides of the monomer aspirator and/or a change between the two CD vacuum intake ports and/or CD vacuum intake subports. Thus a higher volume flow can be removed by suction in alternation—in particular in continuous operation of the apparatus—first through the one CD vacuum intake port and then through the other CD vacuum intake port.

To attain the inventive object, the invention also discloses an apparatus for making a spunbond nonwoven from endless filaments, in particular from endless filaments made of a thermoplastic synthetic resin, wherein a spinneret is provided for spinning the filaments and a cooler is provided for cooling the filaments, wherein at least one monomer aspirator is preferably provided between the spinneret and the cooler for suction removal of gases formed during the spinning process, wherein the monomer aspirator has vacuum flow cross sections and preferably at least two CD vacuum intake ports provided one after the other in the machine direction MD, each extending transversely—preferably perpendicularly—to the machine direction (CD) and opposite (one another) with respect to the spinning zone, the flow cross section of the vacuum flow cross sections—in particular the CD vacuum intake ports—is and/or is adjustable to more than 11,000 $mm^2/m$ of spinning zone, in particular more than 12,000 $mm^2/m$ of spinning zone (transversely to the machine direction, i.e. measured in the CD direction), advantageously over 20,000 $mm^2/m$ of spinning zone, preferably over 30,000 $mm^2/m$ of spinning zone, very preferably more than 40,000 $mm^2/m$ spinning zone and especially preferably more than 50,000 $mm^2/m$ of spinning zone. According to an embodiment of the invention that is highly recommended, an flow cross section of the vacuum flow cross sections—in particular the CD vacuum intake ports—preferably is and/or is adjustable over 60,000 $mm^2/m$ of spinning zone and preferably over 65,000 $mm^2/m$ of spinning zone. The flow cross section and/or the adjustable flow cross section of the vacuum flow cross sections—in particular the CD vacuum intake ports is up to 100,000 $mm^2/m$ of spinning zone, preferably up to 90,000 $mm^2/m$ of spinning zone and especially preferably up to 85,000 $mm^2/m$ of spinning zone.

The respective flow cross sections of the CD vacuum intake ports are preferably designed and/or adjustable such that a higher volume flow can be removed by suction through one of the two opposite CD vacuum intake ports than through the other CD vacuum port. It is within the scope of the invention that the flow cross section of a CD vacuum port is larger and/or can be adjusted to be larger than the flow cross section of a second CD vacuum port that is opposite with respect to the spinning zone. Thus, for example, the flow cross section of a CD vacuum port downstream in the machine direction MD may be larger and/or adjustable to be larger than the flow cross section of a CD vacuum port that is upstream in the machine direction or vice versa. The flow cross section of the opposite CD vacuum intake ports may also be adjusted to be of different sizes in alternation so that first a larger volume flow can be removed by suction through the one CD vacuum port and then through the other CD vacuum port.

A well-proven embodiment of the monomer aspirator according to the invention is characterized in that a CD vacuum port, preferably two CD vacuum intake ports that are on opposite sides of the spinning zone extend over the entire width of the spinning zone and/or essentially over the entire width of the spinning zone. It is advisable for different volume flows to be removable by suction through the total width of the two opposite CD vacuum intake ports. As already indicated above, suction removal of different volume flows also means that no volume flow and/or essential no volume flow of gas is removed by suction through a CD vacuum port and a volume flow of gas is removed by suction only in the CD vacuum port that is on the opposite side of the spinning zone. Furthermore, different suction removal of volume flows here also means that a volume flow of gas is supplied through a CD vacuum port and gas is removed by suction in the other CD vacuum port that is on the opposite side of the spinning zone.

A tried and tested embodiment of the monomer aspirator according to the invention is characterized in that a larger volume flow can be and/or is removed by suction in a CD vacuum intake port continuously over its total length transversely to the machine direction than in the CD vacuum port on the opposite side of the spinning zone. However, it is also within the scope of the invention that CD vacuum intake subports are provided, provided on each side of the spinning zone one after the other transversely to the machine direction and a higher volume flow is removed by suction through at least one CD vacuum intake subport on the first side of the spinning zone than through an opposite and/or directly opposite CD vacuum intake subport on the second side of the spinning zone. However, a lower volume flow can also be removed by suction through at least one additional CD vacuum intake subport on the first side of the spinning zone than through a CD vacuum intake subport on the second side of the spinning zone on the opposite and/or directly on the opposite side. The CD vacuum intake subports provided on one side of the spinning zone and having different directions of gas flow may also be provided directly side by side transversely to the machine direction or at a distance from one another. Thus, a plurality of pairs of opposite CD vacuum subports may be provided in distribution over the width of the spinning zone, transversely to the machine direction, so that the provision advantageously still holds for each pair of CD vacuum intake subports on opposite sides of the spinning zone that a larger volume flow of gas can be removed by suction through a CD vacuum intake subport and through the other CD vacuum intake subport on the opposite side directly.

A highly recommended embodiment of the invention is characterized in that the ratio of the volume flow $V_1$ removed by suction through a CD vacuum port to the volume flow $V_2$ removed by suction through the other CD vacuum port on the opposite side of the spinning zone is 6:1 to 1.1:1, preferably 5.5:1 to 1.3:1, especially 5.5:1 to 1.5:1 and especially preferably 5:1 to 1.75:1. According to one embodiment, the above-described volume flow ratios can also be implemented for opposite subports of the CD vacuum intake ports (opposite CD vacuum intake subports). Several pairs of CD vacuum intake subports are then preferably provided in a uniform distribution in the CD direction.

A recommended embodiment of the invention is characterized in that a CD vacuum port is designed as at least one CD vacuum gap, extending in the CD direction (in a preferred embodiment, preferably one CD vacuum gap). According to one embodiment, the CD vacuum gap is subdivided into multiple CD vacuum gap subsections. According to one preferred embodiment, 4 to 40, preferably 6 to 35 and especially 8 to 30 CD vacuum gap subsections are preferably provided side by side at the same vertical width in the CD direction. The length of these CD vacuum gap subsections in the CD direction is 10 to 70 cm, preferably 10 to 60 cm and especially 15 to 40 cm. The CD vacuum gap subsections provided side by side supplement one another to form the CD vacuum gap extending in the CD direction. Basically two or more CD vacuum gaps and/or CD vacuum gap subsections may be provided one above the other in the vertical direction on each side of the spinning zone.

It is within the scope of the invention for the opening cross-sectional area of the at least one CD vacuum gap (preferably one) provided on one side of the spinning zone to be larger than the opening cross-sectional area of the at least one (preferably one) CD vacuum gap provided on the other side of the spinning zone. Thus, for example, the opening cross-sectional area of the one and/or the at least one CD vacuum gap that is downstream as seen in the machine direction (outlet side of the spunbond nonwoven web), may be larger than the opening cross-sectional area of the one or the at least one CD vacuum gap on the upstream side as seen in the machine direction (inlet side of the spunbond nonwoven web) or vice versa.

According to one recommended embodiment, the gap width h and/or the vertical gap width h of the two opposite CD vacuum gaps are different, and, for example, the gap width $h_A$ of the CD vacuum gap downstream in the machine direction (outlet side of the spunbond nonwoven web) is greater than the gap width $h_z$ of the CD vacuum gap upstream, as seen in the machine direction (inlet side of the spunbond nonwoven web). Advantageously the gap width h of the one CD vacuum gap is more than twice and preferably more than three times the gap width h of the other CD vacuum gap. The CD vacuum gaps according to recommendation have a gap width and/or a vertical gap width h of 2 to 50 mm, preferably of 4 to 40 mm and especially of 4 to 35 mm. According to a preferred embodiment of the invention, the gap width h of the greater CD vacuum gap is 20 to 50 mm, advantageously 25 to 45 mm, and the gap width h of the lower CD vacuum gap preferably is 2 to 12 mm, in particular 2 to 10 mm. Basically, however, the two opposite CD vacuum gaps may also have the same width, and then the volume flow removed by suction at the two CD vacuum gaps is implemented in different ways through the settings—especially cross-sectional settings, in particular to the at least one collecting chamber and/or to the collecting chambers and/or in the suction line and/or in the suction lines. As already explained above, it is also within the scope of the invention that the suction removal of the higher volume flow switches continuously from the one side of the monomer aspirator to the other side of the monomer aspirator and/or switches continuously between the one CD vacuum gap and the other CD vacuum gap. In principle, the gap width of the CD vacuum gap could also be adjusted accordingly so that they alternate.

Within the scope of suction removal of the monomer according to the invention, the different volume flows removed by suction through at least two CD vacuum intake ports on opposite sides of the spinning zone can be adjusted through the geometric parameters of the CD vacuum intake ports and/or CD vacuum intake subports and in particular the CD vacuum gaps and/or CD vacuum gap subsections. Alternatively or additionally, these different volume flows may also be adjusted through the design and/or construction of the collecting chamber(s) and/or collecting line(s) and/or collecting duct(s) assigned to each CD vacuum port. As already explained above, or at least one collecting chamber is advantageously assigned to each CD vacuum port, at least one suction line, advantageously multiple suction lines being connected thereto. The volume flow removed by suction in the respective CD vacuum port can be adjusted through the number and/or size and/or cross section of the suction lines. It is advisable for two to twelve suction lines to be connected to a collecting chamber of a CD vacuum port, preferably four to 10 suction lines that are connected per meter of spinning zone and through which gas is removed by suction from the collecting chamber. It is within the scope of the invention for the apparatus according to the invention to have at least two collecting chambers and preferably one collecting duct connected to each collecting chamber.

A particularly preferred embodiment of the monomer aspirator according to the invention is characterized in that the monomer aspirator has at least two MD vacuum intake ports extending in the machine direction MD and on opposite sides of the spinning zone. The MD vacuum intake ports are preferably provided at the spinneret and in the upstream walls that extend in the MD direction and border the film-forming space beneath the spinneret. It is within the scope of the invention that the upstream end walls and thus also the MD vacuum intake ports are designed to be shorter or much shorter than the side walls of the filament-forming space extending in the CD direction and thus also shorter than the CD vacuum intake ports. The MD vacuum intake ports advantageously extend transversely, preferably perpendicularly to the CD vacuum intake ports. Gases are also removed by suction through the MD vacuum intake ports just as they were through the CD vacuum intake ports and are removed from the filament-forming space beneath the spinneret. An MD vacuum port is advantageously designed as at least one MD suction gap extending in the MD direction. According to one embodiment such an MD suction gap is subdivided into a plurality of MD suction gap subsections, in particular into two to five MD suction gap subsections, preferably into two to three MD suction gap subsections. The MD suction gap subsections are preferably provided one after the other in the MD direction and are advantageously of the same vertical width and/or essentially at the same vertical width. The length of the MD suction gap subsections is preferably 10 to 70 cm, especially 10 to 60 cm, especially preferably 15 to 40 cm and in particular 10 to 20 cm. The length is measured in the MD direction. The vertical gap width h of an MD suction gap and/or MD suction gap subsection is 2 to 50 mm according to recommendation, preferably 25 to 45 mm and very preferably 2 to 12 mm. According to one embodiment, the suction through the MD vacuum intake ports may also be regulated separately, i.e. independently of the suction through the CD vacuum intake ports. According to another embodiment of the invention, the MD vacuum intake ports are connected to the collecting chambers and/or collecting ducts of the CD vacuum intake ports. Thus an MD vacuum port may be connected to at least one collecting chamber and/or to at least one collecting duct of a CD vacuum port. Then a joint suction removal advantageously takes place through each of the CD vacuum ports and the respective MD vacuum port.

It is within the scope of the invention that two opposite CD vacuum intake ports (preferably two opposite CD vacuum gaps) are of the same vertical width and/or essentially at the same vertical width as two opposite MD vacuum intake ports—preferably as two opposite MD suction gaps. Basically, a continuous suction removal gap could run along the periphery of the spinning zone. However, according to a preferred embodiment of the invention, both the opposite CD vacuum gaps and the opposite MD suction gaps are subdivided into CD vacuum gap subsections and MD suction gap subsections provided side by side at the same vertical width or essentially the same vertical width.

It is also within the scope of the invention that a CD vacuum port and/or a CD vacuum gap is longer or much longer than an MD vacuum port or an MD suction gap. A CD vacuum port or a CD vacuum gap is preferably at least twice as long, especially at least 2.5 times as long, very preferably at least three times as long and in particular at least four times as long as an MD vacuum port and/or MD suction gap. The above-described lengths are preferably measured transversely and especially perpendicularly to the machine direction (CD direction) and in the machine direction (MD direction).

The total volume flow of gas removed by suction through the CD vacuum intake ports and according to the preferred embodiment of the invention, preferably the MD vacuum intake ports is 35 to 1200 $m^3/h$ per m of spinning zone, preferably 40 to 1100 $m^3/h$ per m of spinning zone and especially 50 to 1000 $m^3/h$ per m of spinning zone. According to the invention, the volume flow removed by suction through a CD vacuum port is higher than the volume flow removed by suction through the CD vacuum port on the opposite side of the spinning zone.

It is possible that, with the apparatus according to the invention, soiling and/or contamination of the surfaces occur(s) on one suction side (in particular in the region of a CD vacuum port) because of the throttled volume flow—in particular due to formation of condensate. This soiling can be reduced by suitable gas management. According to one embodiment of the invention, surfaces at risk of soiling at at least one vacuum port and/or CD vacuum port are covered by covering materials and/or covering sheets that pick up dirt and/or condensate, in particular being absorbent for dirt and/or condensate and/or insulating by absorbing them. In doing so, the cover materials and/or covering web is/are affixed to the at risk surfaces in a suitable manner. For example, melt-blown nonwovens or the like may serve as the covering. Alternatively or additionally, according a recommended embodiment, the surfaces at risk of soiling are regulated at a temperature to prevent the soiling and/or formation of condensate, in particular by heating.

The invention is based on the discovery that the object of the invention can be attained particularly effectively if, on the one hand, the features of the suction removal of monomer as described above are implemented and, on the other hand, if certain specifications are maintained in the embodiment of the spinneret and/or with respect to the hole of the spinneret. The term "hole of the spinneret" refers to the passages through which the molten synthetic for the filaments spun by the spinneret passes. According to one particularly preferred embodiment of the apparatus according to the invention, the spinneret has a hole density of 1 to 6 hole per $cm^2$, preferably 2 to 5 hole per $cm^2$, especially 2 to 4.5 hole per $cm^2$, in particular 2 to 4 hole per $cm^2$, and most preferably of 2.2 to 3.2 hole per $cm^2$. It is advisable for the hole density of the spinneret to be lower in the central region of the spinneret than in the outer regions of the spinneret and for the hole density in the central region of the spinneret to preferably be 0 to 1 hole per $cm^2$. The inside diameter of the hole according to recommendation is 0.2 to 0.9 mm, in particular 0.3 to 0.8 mm. These preferred features of spinneret have proven to be particularly successful within the scope of the invention in conjunction with the difference in suction of the volume currents in the monomer suction removal according to the invention.

The depth of the spinning zone is preferably 120 to 400 mm, especially 150 to 350 mm, more preferably 170 to 300 mm and especially preferably 185 to 270 mm. Depth of spinning zone refers in particular to the extent of the spun filament bundle in the machine direction MD. According to one embodiment of the invention that is recommended in particular, the depth of spinning zone is 195 to 260 mm. With the depths of the spinning zone cited above, the object of the invention can be attained without any problems, and defects and/or flaws in the spunbond nonwoven web deposited can be prevented and/or reduced substantially in comparison with the known measures. With the measures known from practice, unwanted inhomogeneities and/or defects have occurred in the deposited spunbond nonwoven web in particular at greater spinning zone depths. This disadvantage can be prevented effectively with the apparatus according to the invention.

A particularly recommended embodiment of the apparatus according to the invention is characterized in that a cooler and a stretcher connected thereto are provided downstream from the monomer aspirator, as seen in the direction of filament flow. It is advisable for the stretcher to have an intermediate passage that converges in the direction of filament flow as well as a stretching passage connected thereto. According to a particularly preferred embodiment of the invention, the intermediate passage has at least two converging passage sections provided one after the other and/or side by side in the filament-travel direction. It is recommended that the first and/or upper passage section in the filament-travel direction should have a shorter length than the second or lower passage section in the filament-travel direction. The aperture angle of the first and/or upper converging passage section of the intermediate passage is preferably larger than the aperture angle of the second and/or lower converging passage section of the intermediate passage. It is within the scope of the invention for the intermediate passage and/or the lower converging passage section of the intermediate passage to develop into the stretching passage and/or the draw-down passage of the stretcher more or less. The intermediate passage and/or the lower passage section of the intermediate passage and the stretching passage and/or the draw-down passage may basically have the same convergence.

At least one diffuser is preferably provided downstream from the stretcher in the filament-travel direction and following that there is a deposition support for depositing the filaments to form the spunbond nonwoven. It is especially preferably within the scope of the invention for at least two diffusers, in particular two diffusers to be provided downstream from the stretcher in the filament-travel direction and in doing so it has proven successful for at least one ambient air inlet gap and/or an ambient air inlet gap to be provided between the two diffusers for emission of ambient air. A most especially recommended embodiment of the apparatus according to the invention is characterized in that the assembly of the cooler and the stretcher is designed as a closed system into which there is no other air supply in addition to the supply of cooling air to the cooler. The invention is based on the discovery that the monomer aspirator according to the invention operates optimally in particular in combination with such a closed system.

To attain the object of the invention, the invention also discloses a method of making a spunbond nonwoven from endless filaments, in particular from endless filaments made of a thermoplastic synthetic resin, wherein the filaments are spun by a spinneret, where gases released in the filament-forming space at the spinneret, in particular beneath the spinneret, as in the spinning process, are removed by suction (monomer suction), wherein

- at least one volume flow of the resulting gases is removed by suction through at least two CD vacuum intake ports provided one after the other in the machine direction MD,
- the volume flow removed by suction through a CD vacuum port is greater than the volume flow removed by suction through the other CD vacuum port such that the filaments are then cooled and drawn and are finally deposited on a deposition support to form the spunbond nonwoven.

A particularly successful embodiment of the method according to the invention is characterized in that the filaments are made at a throughput of 100 to 350 kg/h/m, preferably at a throughput of 150 to 320 kg/h/m, preferably with a throughput of 180 to 300 kg/h/m and very preferably with a throughput of 200 to 300 kg/h/m. The invention is thus based on the discovery that the object of the invention—in particular preventing inhomogeneities and defects in the spunbond nonwoven web—can be attained with no problem in particular also in the case of higher throughputs. It is within the scope of the invention that the filaments are made at a filament speed of 2000 to 4200 m/min, preferably 2200 to 4000 m/min and in particular 2300 to 3900 m/min.

The invention is based on the discovery that a spunbond nonwoven characterized by an excellent homogeneity and having practically no defects and/or flaws can be made with the apparatus according to the invention and the method according to the invention. The drips and hard pieces that are described above as an advantage can be largely prevented with the apparatus according to the invention and/or reduced to a minimum. It is particularly advantageous that more or less defect-free deposition of a nonwoven is possible, even with deep and/or wide spinning zones, as well as at high throughputs and at high filament speeds. No further complex measures beyond suction removal of monomer according to the invention are needed to implement the advantages achieved according to the invention. No complex additional apparatus components in particular are necessary to achieve an effective solution to the technical problem. Within the scope of the invention, the combination of the monomer suction features, on the one hand, and the embodiment of the spinneret, on the other hand, become particularly important. To this end, reference is made to the hole features of the spinneret described above. As a result, a surprisingly homogeneous and defect-free deposition of the spunbond nonwoven can be achieved with the apparatus according to the invention and with the method according to the invention with a relatively deep spinning zone and a relatively high throughput. This is surprising since the defect rate usually increases with the throughput when using the apparatuses and methods known in the past. With regard to the substantial advantages achieved, the apparatus according to the invention is characterized by its simplicity and relatively low cost.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
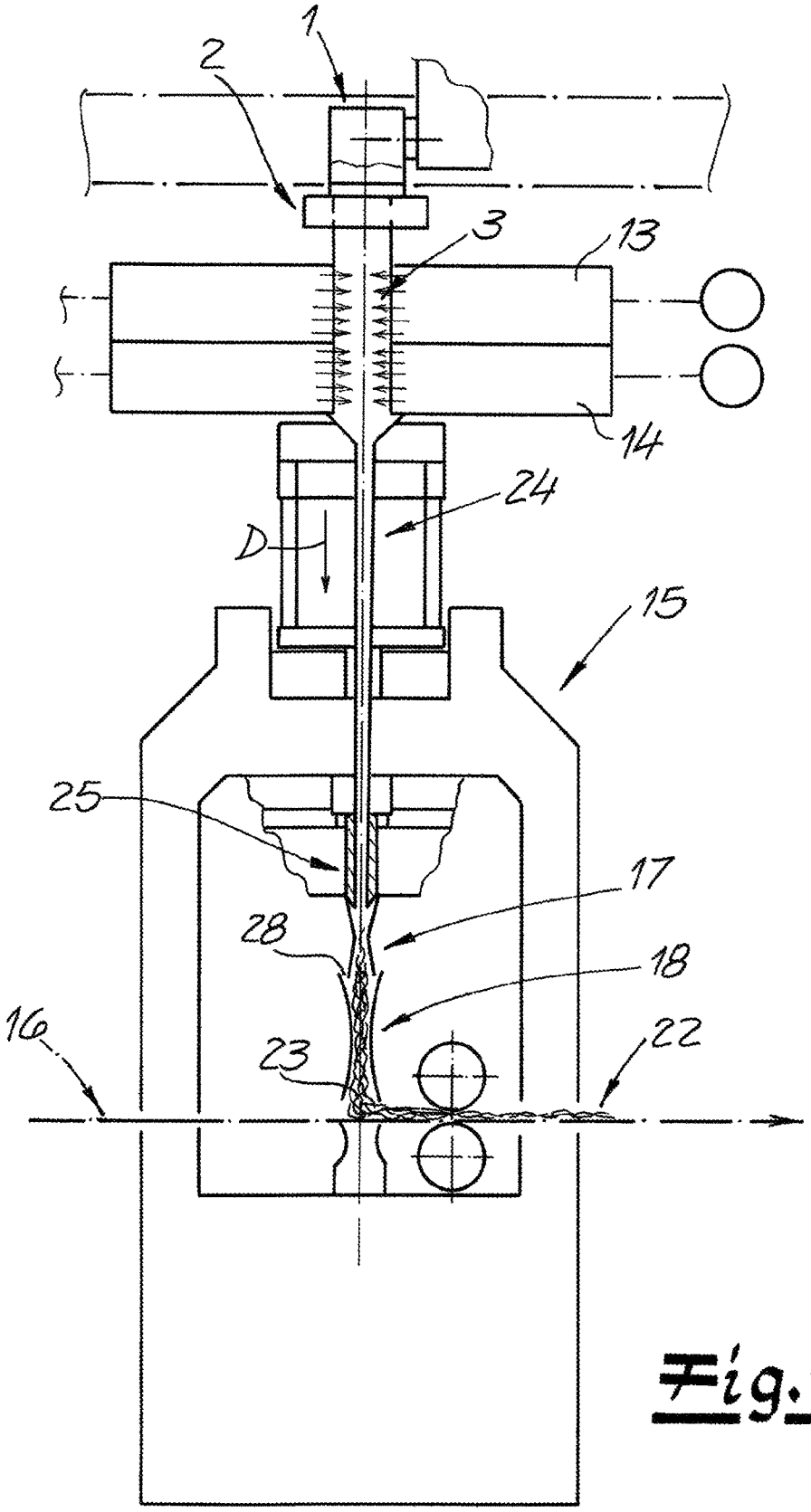
FIG. 1 is a vertical section through an apparatus according to the invention.

As seen in FIG. 1, an apparatus according to the invention for making a spunbond nonwoven 22 from endless filaments 23 that consist in particular and/or essentially of a thermoplastic synthetic resin. The filaments 23 are spun using a spinneret 1 and are passed downward in a filament-travel direction D D through a filament-forming space 29 beneath this spinneret 1 through a monomer aspirator 2 for suction removal of gases formed during the spinning process.

A cooler 3 for toe filaments is provided downstream from and/or beneath the monomer aspirator 2, as seen in the filament-travel direction D. Preferably this cooler has an air-supply chamber that is subdivided into two compartments 13, 14. Preferably process air and/or cooling air at different temperatures can be projected from these two compartments 13, 14 toward the descending filament bundle.

A stretcher 15 is connected to the cooler 3 downstream in the filament-travel direction D. This stretcher 15 preferably and in the illustrated embodiment has an intermediate passage 24 that converges in the filament-travel direction D as well as a stretching passage 25 connected thereto.

As recommended and in the illustrated embodiment, the assembly formed from the cooler 3 and the stretcher 15 is a closed system. In addition to the supply of cooling air and/or process air to the cooler 3, there is no further supply of air into this closed system. According to the preferred embodiment of the invention, at least one diffuser 17, 18 is connected to the stretcher 15 downstream in the filament-travel direction D.

Advantageously, two diffusers 17, 18 provided one after the other and/or side by side are provided. It is advisable for an ambient air inlet gap 28 to be provided between the two diffusers 17 and 18 for the admission of ambient air. Preferably the filaments 23 are deposited on a deposition support 16 to form the spunbond nonwoven downstream from the diffusers 17, 18. Preferably the deposition support 16 is designed as a continuously revolving endless screen belt.

According to the invention, the monomer aspirator 2 for suction removal of the gases formed in the spinning process is provided at the spinneret 1. Preferably the monomer aspirator 2 is provided in the filament-forming space 29 beneath the spinneret 1. As recommended, this monomer aspirator 2 has two CD vacuum intake ports 5 and 6 provided one after the other in the machine direction MD, which here is the same as the filament-travel direction D, and each extending transversely to the machine direction and being on opposite sides of the spinning zone 4. Preferably the CD vacuum intake ports 5 and 6 are provided in side walls 26 on opposite sides and extend in the CD direction, that is open transversely of the direction D, bordering the filament-forming space 29. These CD vacuum intake ports 5 and 6 that are on opposite sides of the spinning zone 4 are preferably each designed as CD vacuum gaps 7 and 8 extending transversely and/or perpendicularly to the machine direction. Preferably the two CD vacuum gaps 7 and 8 are each subdivided into a plurality of CD vacuum gaps sections 7' and 8'. These CD vacuum gap subsections 7' and 8' are preferably provided side by side as well as being at the same width vertically. It is within the scope of the invention for the two CD vacuum gaps 7 and 8 that are on opposite sides to be set up such that a higher volume flow of gases can be removed by suction through one of the two CD vacuum gaps 7 and 8 than through the other CD vacuum gaps 7 and 8 on the opposite side.

In the illustrated embodiment, a higher volume flow $V_A$ can be removed by suction through the downstream CD vacuum gap 8, as seen in the machine direction (outlet side) of the spunbond nonwoven web than through the upstream CD vacuum gap 7 in the machine direction (inside of the spunbond nonwoven web). In the illustrated embodiment, the rate of the volume flow $V_A/V_E$ may amount to 3:1. In the illustrated embodiment, the vertical gap width $h_A$ of the downstream CD vacuum gap 8, as seen in the machine direction (outlet side), is larger than the vertical gap width $h_A$ of the upstream CD vacuum gap 7, as seen in the machine direction (inlet side). However, it may be possible to vacuum up a higher volume flow $V_E$ through the upstream CD vacuum gap 7, as seen in the machine direction (inlet side of the spunbond nonwoven web) than through the downstream CD vacuum gap 8, as seen in the machine direction (outlet side of the spunbond nonwoven web). The ratio of the volume flows and the vertical gap widths can then be provided more or less as the converse to the above specifications.

In the illustrated embodiment, a depth t of the spinning zone 4 may amount to 200 mm and it is possible to work with a throughput of 230 kg/h/m and with a filament speed of 3300 m/min in this illustrated embodiment.

According to a preferred embodiment, the monomer aspirator 2 also has two opposite MD vacuum intake ports 9 and 10 that extend in the machine direction MD and on opposite sides of the spinning zone 4. The MD vacuum intake ports 9 and 10 are preferably provided in opposite walls 27 that extend in the MD direction and border the filament-forming space. The walls 27 are advantageously connected to the side walls 26 that extend in the CD direction. The side walls 26 (in the CD direction) are as recommended longer or much longer than the side walls 27 (in the MD direction). Preferably the MD vacuum intake ports 9 and 10 are preferably designed as two opposite MD suction gaps 11 and 12 extending in the MD direction. Advantageously, the MD suction gaps 11 and 12 are also provided at the same vertical width as well as at the same vertical width as the CD vacuum gaps 7 and 8. The MD suction gaps 11 and 12 are preferably each subdivided into MD suction gap subsections 11' and 12', namely as recommended, each in two MD suction gap subsections 11' and 12'.

Figure 3:
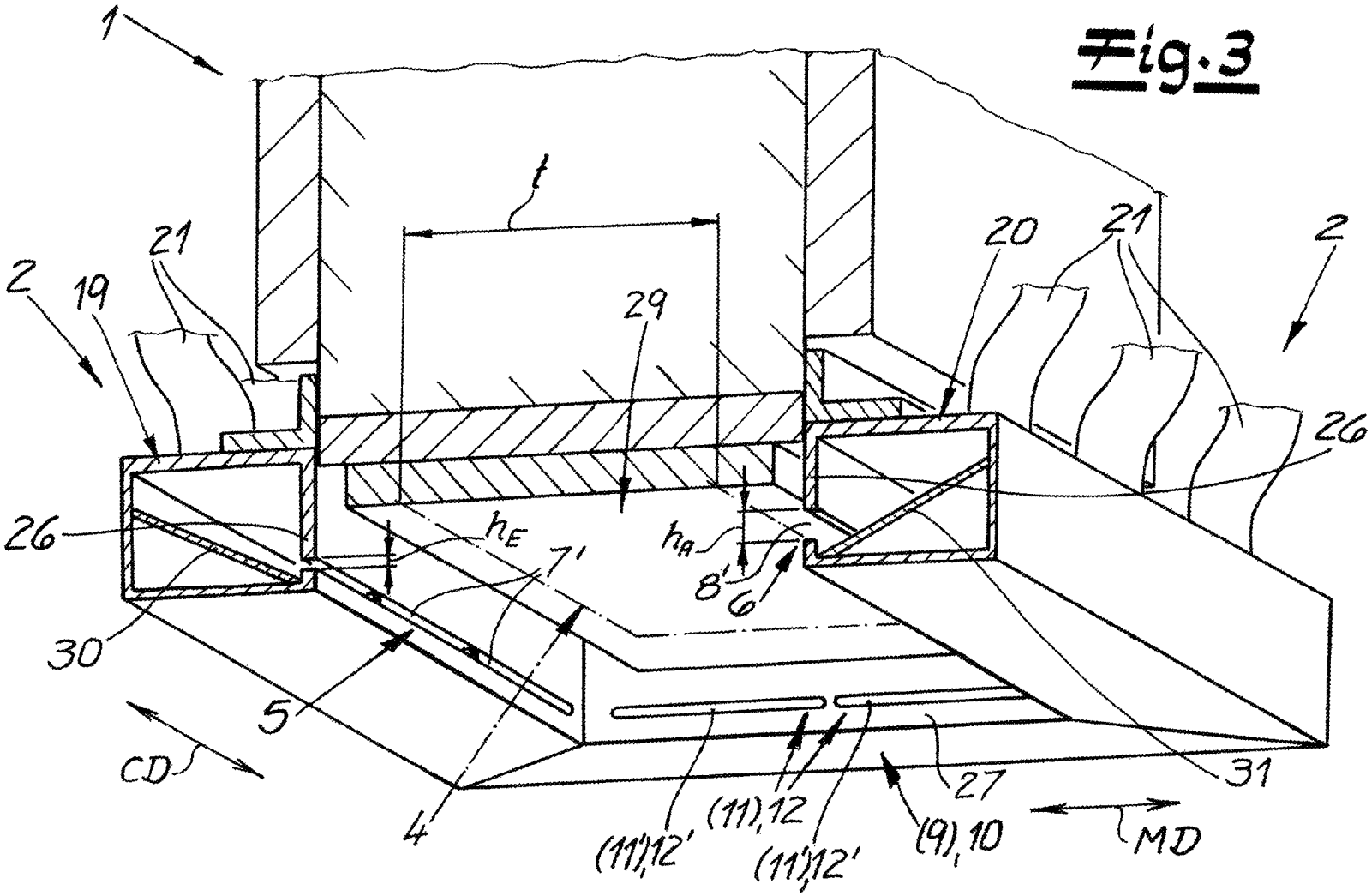
FIG. 3 is a perspective view of a monomer aspirator according to the invention.

Advantageously, collecting chambers 19 and 20 for the gases removed by suction through the CD vacuum gaps 7 and 8 are provided at each CD vacuum gap 7 and 8. A plurality of suction lines 21 for suction removal of the gases as part of the suction removal of monomer is connected to each collecting chamber 19 and 20. Preferably each collecting chamber 19 and 20 is connected to a collecting duct 32, 33 via the suction lines 21. Advantageously at least one suction device (not shown)—for example, in the form of a pump—is connected to the collecting duct 32, 33 for suction removal of the gases. Furthermore, the suction lines 21 may have cutoff elements—for example, in the form of side valves—and the volume flow removed by suction through the CD vacuum gaps 7 and 8 on opposite sides can also be adjusted with these cutoff elements. The collecting ducts 32, 33 are preferably assigned not only to the CD vacuum gaps 7 and 8 but also to the two MD suction gaps 11 and 12 on opposite sides. The gases removed by suction through these MD suction gaps 11 and 12 can thus also be captured in the collecting ducts 32, 33. FIG. 3 also shows that baffles 30, 31 for the gases removed by suction are provided in the collecting chambers 19 and 20.

Figure 2A:
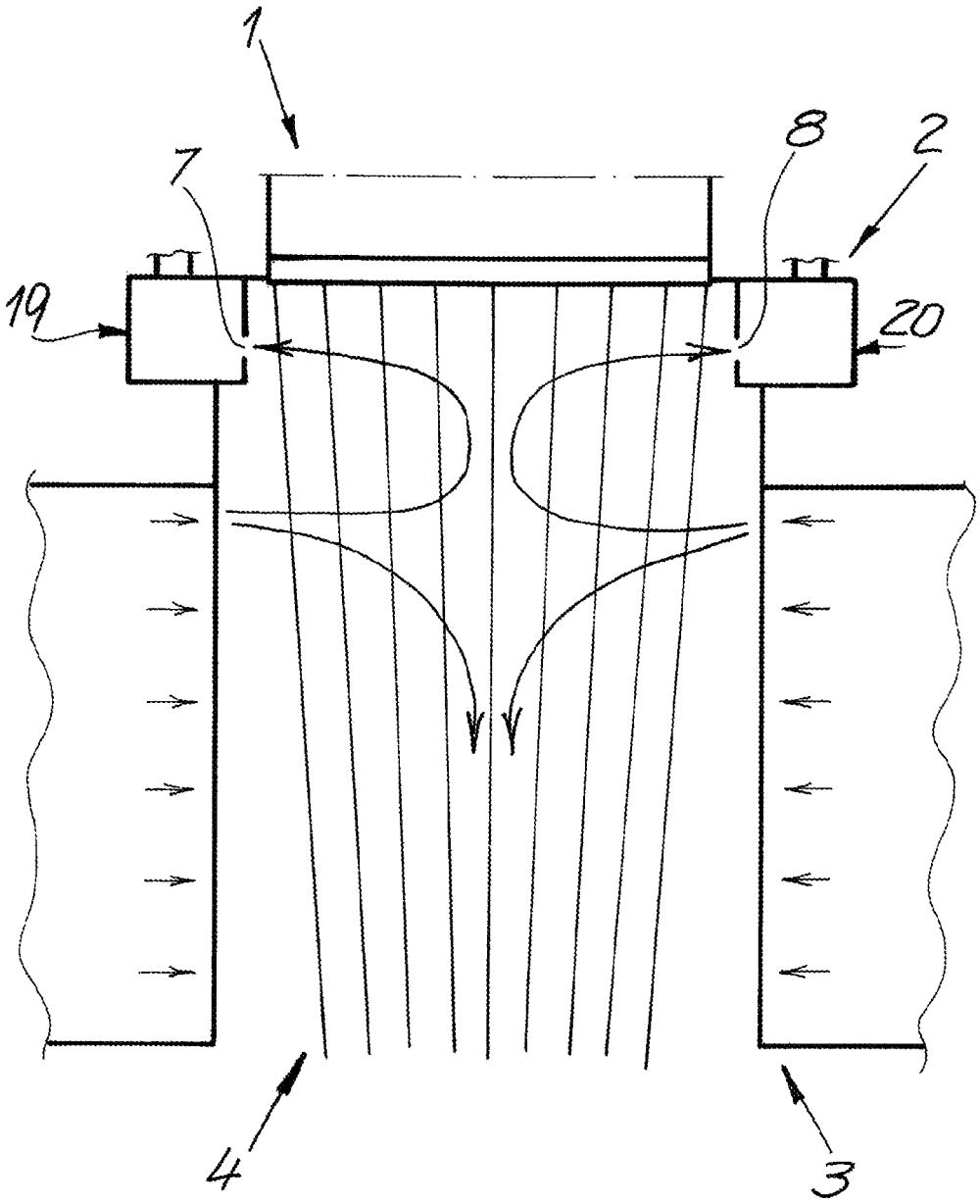
Fig. 2A Prior Art
FIG. 2A is an enlarged detail from FIG. 1 showing suction removal of monomer according to the prior art.
Figure 2B:
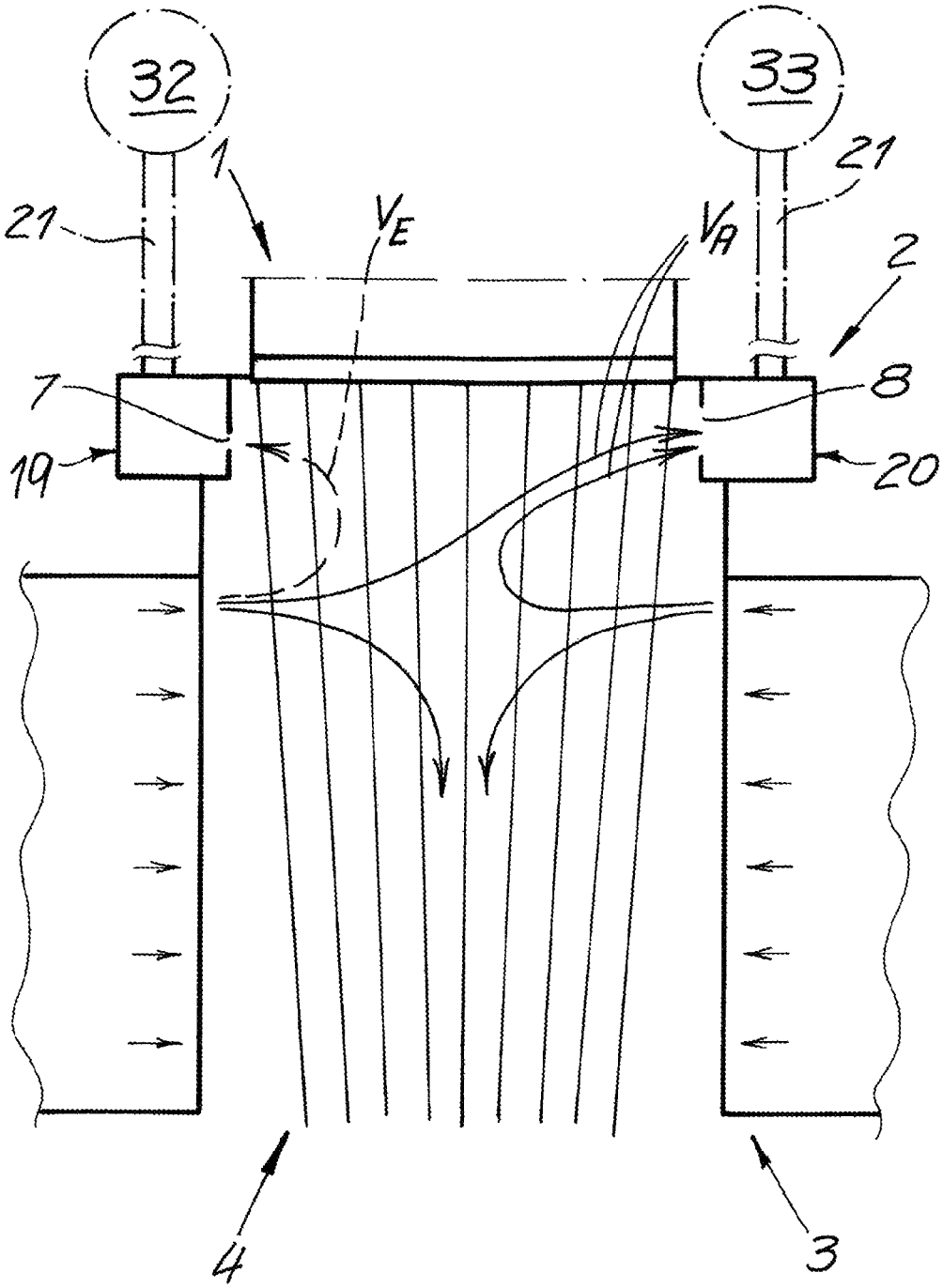
FIG. 2*b* is a view like FIG. 2A but with suction removal of monomer according to the invention.

A comparison of FIGS. 2A and 2B shows the gas flows during suction removal of monomer according to the prior art (FIG. 2A) and the gas flows with the monomer suction removal according to the invention (FIG. 2B). With the prior-art monomer aspirator 2 shown in FIG. 2A, the same volume flow of gases is removed by suction through each of the two CD vacuum intake ports 5 and 6 on opposite sides from the spinning zone 4. It can be seen here that the filament bundle spun by the spinneret 1 is not acted upon by the gas streams in its center. The invention is thus based on the discovery that to this extent this embodiment can result in the formation of drips and/or hard pieces on the filaments so that—as described in the introduction—defects and/or flaws result in the spunbond nonwoven web deposited. However, with the suction removal of monomer according to the invention—as can be seen in FIG. 2B—a higher volume flow is removed by suction on one side of the spinning zone 4. In this embodiment, a higher volume flow $V_A$ is removed by suction through the downstream CD vacuum gap 8 as seen in the machine direction MD (outlet side of the spunbond nonwoven web) than through the upstream CD vacuum gap 7 as seen in the machine direction (inlet side of the spunbond nonwoven web). As also shown in FIG. 2B, this results in the fact that even the filaments provided at the center of the spun filament bundle are acted upon by the gas flow. The invention is based on the discovery that this can effectively prevent the formation of drips and hard pieces on the filaments and thus also can prevent formation of defects and/or flaws in the deposited spunbond nonwoven. FIGS. 2A and 2B also show the introduction of cooling air in the cooler 3. The inflowing cooling air here is symbolized by the arrows pointing down.

We claim:

1. An apparatus for making a spunbond nonwoven from endless filaments of a thermoplastic synthetic resin, the apparatus comprising:

a spinneret for spinning the filaments in a filament-travel direction into a spinning zone;

a monomer aspirator downstream of the spinneret and having two ports serving for vacuum intake and flanking the spinning zone, open toward each other, and each extending transversely to the direction opposite one another; and means connected to the two ports for withdrawing gas through both the ports;

means associated with the ports for varying the flow through the ports such that more gas flows through one of the ports than through the other port and a ratio of the volume flow removed by suction through the one port to the volume flow removed by suction through the other port on the opposite side of the spinning zone is 5.5:1 to 1.3:1; and a cooler downstream of the aspirator for cooling the filaments.

2. The apparatus defined in claim 1, wherein the means for varying is part of the means for withdrawing and operates such that more gas is pulled through the one port than through the other port.

3. The apparatus defined in claim 2, wherein the flow cross section of the one port is greater than the flow cross section of the other port.

4. The apparatus defined in claim 3, wherein both ports are slots extending transversely of the direction, a gap width measured in the direction of the one port being at least twice as large as a gap width measured in the direction of the other port.

5. The apparatus defined in claim 1, wherein a combined flow cross section of the two ports is more than 11,000 $mm^2/m$ of the spinning zone.

6. The apparatus defined in claim 1, wherein each of the ports extends transversely of the direction generally over a full width of the spinning zone.

7. The apparatus defined in claim 1, wherein the ports are slots extending transverse to the direction and at least one of the ports is formed by a row extending transverse to the direction of short slot-shaped subports.

8. The apparatus defined in claim 1, further comprising:

at least one collecting chamber for the suction gases connected to each of the ports, the means for varying or means for withdrawing including at least one throttle element that provided in one of the collecting chambers or in or on a suction line connected to the one collecting chamber.

9. The apparatus defined in claim 1, wherein the means for varying or means for withdrawing alternates which of the ports aspirates more gas from one side to the other of the spinning zone.

10. The apparatus defined in claim 1, wherein each of the ports is formed as a row extending transversely of the direction of slot-shaped subports.

11. The apparatus defined in claim 1, wherein surfaces at risk of soiling at the ports are covered by covering materials and a covering web that absorbs or insulates by holding and absorbing dirt.

12. The apparatus defined in claim 1, further comprising:

means for heating surfaces at risk of soiling at the ports to prevent soiling or to prevent formation of condensation.

13. The apparatus defined in claim 1, wherein the spinneret has a hole density of 1 to 6 hole/$cm^2$.

14. The apparatus defined in claim 13, wherein the hole density of the spinneret is lower in the central region of the spinneret than in outer regions of the spinneret and the hole density in the central region of the spinneret is 0 to 1 hole/$cm^2$.

15. The apparatus defined in claim 1, wherein a depth in the filament-travel direction of the spinning zone is 120 to 350 mm.

16. The apparatus defined in claim 1, wherein the cooler has at least two compartments provided one after the other in the direction and from which cooling air at different temperatures is projected at the filaments.

17. The apparatus defined in claim 1, further comprising:

a stretcher connected downstream of the cooler in the direction of filament flow; and a deposition support for depositing the filaments to form the spunbond nonwoven downstream from the stretcher in the filament-travel direction, an assembly of a cooler and the stretcher being a closed system into which there is no further supply of air except for cooling air in the cooler.

18. A method of making a spunbond nonwoven from endless filaments made of a thermoplastic synthetic resin, the method comprising the steps of:

spinning the filaments with a spinneret and passing the spun filaments in a filament-travel direction through a spinning zone;

providing two ports serving for vacuum intake flanking the spinning zone and opening oppositely transversely into the zone; and aspirating from the zone a greater volume of gas through one of the ports than through the other of the ports with a ratio of the volume flow removed by suction through the one port to the volume flow removed by suction through the other port on the opposite side of the spinning zone being 5.5:1 to 1.3:1.

19. The method defined in claim 18, wherein the filaments are spun at a throughput of 100 to 350 kg/h/m.

20. The method defined in claim 18, wherein the filaments are spun at a filament speed of 2000 to 4200 m/min.

* * * * *